US006684512B1

(12) United States Patent
Bareis

(10) Patent No.: US 6,684,512 B1
(45) Date of Patent: Feb. 3, 2004

(54) ROLLING SHEET MATERIAL CUTTING DEVICE

(76) Inventor: Kathryn M. Bareis, 4950 S. Lowes Creek Rd., Eau Claire, WI (US) 54701

( * ) Notice: Subject to any disclaimer, the term of this patent is extended or adjusted under 35 U.S.C. 154(b) by 21 days.

(21) Appl. No.: 10/108,033

(22) Filed: Mar. 26, 2002

(51) Int. Cl.[7] ..... B26B 3/00
(52) U.S. Cl. ..... 30/290; 30/294
(58) Field of Search ..... 30/293, 294, 2, 30/289, 290

(56) References Cited

U.S. PATENT DOCUMENTS

| | | | | | |
|---|---|---|---|---|---|
| 1,586,646 | A | * | 6/1926 | Belevin et al. | |
| 1,776,046 | A | * | 9/1930 | Schmidt | 30/294 |
| 4,549,351 | A | * | 10/1985 | Stanbery et al. | 30/293 |
| 5,127,162 | A | | 7/1992 | Mansfield | |
| 5,485,676 | A | * | 1/1996 | Terhorst | 30/294 |
| 5,561,905 | A | | 10/1996 | Sherman | |
| 5,715,605 | A | | 2/1998 | Nadeau | |
| 5,737,842 | A | | 4/1998 | Freedman | |
| 5,771,586 | A | * | 6/1998 | Lotarski et al. | 30/290 |
| 5,881,463 | A | | 3/1999 | Casteel et al. | |
| 6,484,404 | B1 | * | 11/2002 | Kao | 30/293 X |
| 2003/0115760 | A1 | * | 6/2003 | Martinez | 30/294 |

* cited by examiner

*Primary Examiner*—Douglas D. Watts
(74) *Attorney, Agent, or Firm*—Anthony J. Bourget

(57) ABSTRACT

The present invention is a rolling device for cutting sheet material including a planar body member supported vertically on wheeled axles oriented perpendicularly to the vertical planar body member. The planar body member includes a cutting notch and a contained cutting blade member with a cutting edge exposed within the cutting notch. A handle member is secured to the planar body member and extends upwardly opposite the wheeled axles. A crossbar can be attached to the handle member. A user grasps the handle member, or crossbar, and rolls the planar body member forward on the wheeled axles to cut a sheet of material passing into the cutting notch.

31 Claims, 5 Drawing Sheets

ROLLING SHEET MATERIAL CUTTING DEVICE

BACKGROUND OF THE INVENTION

1. Field of the Invention

The present invention relates generally to a device for cutting sheet material, and more specifically, to a rolling device with an easily grasped handle for cutting sheet material, such as paper.

2. Background Information

Cutting with scissors requires dexterity involving fine motor skills. Young children often encounter difficulties in handling and operating a scissors for cutting sheet material, such as paper. Likewise, individuals with certain physical disabilities and those with limited mental capabilities often encounter difficulties in using a scissors.

Some examples of inventions concerned with cutting devices for which patents have been granted are found in the following: Mansfield, U.S. Pat. No. 5,127,162; Sherman, U.S. Pat. No. 5,561,905; Nadeau, U.S. Pat. No. 5,715,605; Freedman, U.S. Pat. No. 5,737,842; and Casteel et al., U.S. Pat. No. 5,881,463.

However, these disclosed devices require a minimum degree of dexterity in their operation. Thus, there is an unmet need for a sheet material cutting device that can be used by young individuals or those with limited physical or mental capabilities. The device of the present invention meets this need, while providing many additional features that are unique to the structure described herein.

SUMMARY OF THE INVENTION

The present invention is directed to a rolling device for cutting sheet material. The device includes a planar body member supported vertically on rolling support means for translational movement of the device. In one embodiment, the rolling support means includes wheeled axles positioned in a plane and oriented perpendicularly to the vertical planar body member. The planar body member includes a cutting notch with open and closed ends with the notch open end positioned adjacent and above the rolling support means. The planar body member includes a contained cutting blade member with a cutting edge exposed within the cutting notch closed end. A handle member is secured to, and coplanar with, the planar body member, with the handle member extending upwardly, opposite the rolling support means. The handle member and planar body member form a grasping notch there between, whereby a user grasps the handle member and rolls the planar body member forward on the rolling support means to cut a sheet of material passing into the cutting notch.

The above summary of the present invention is not intended to describe each illustrated embodiment or every implementation of the present invention. The figures and detailed description that follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
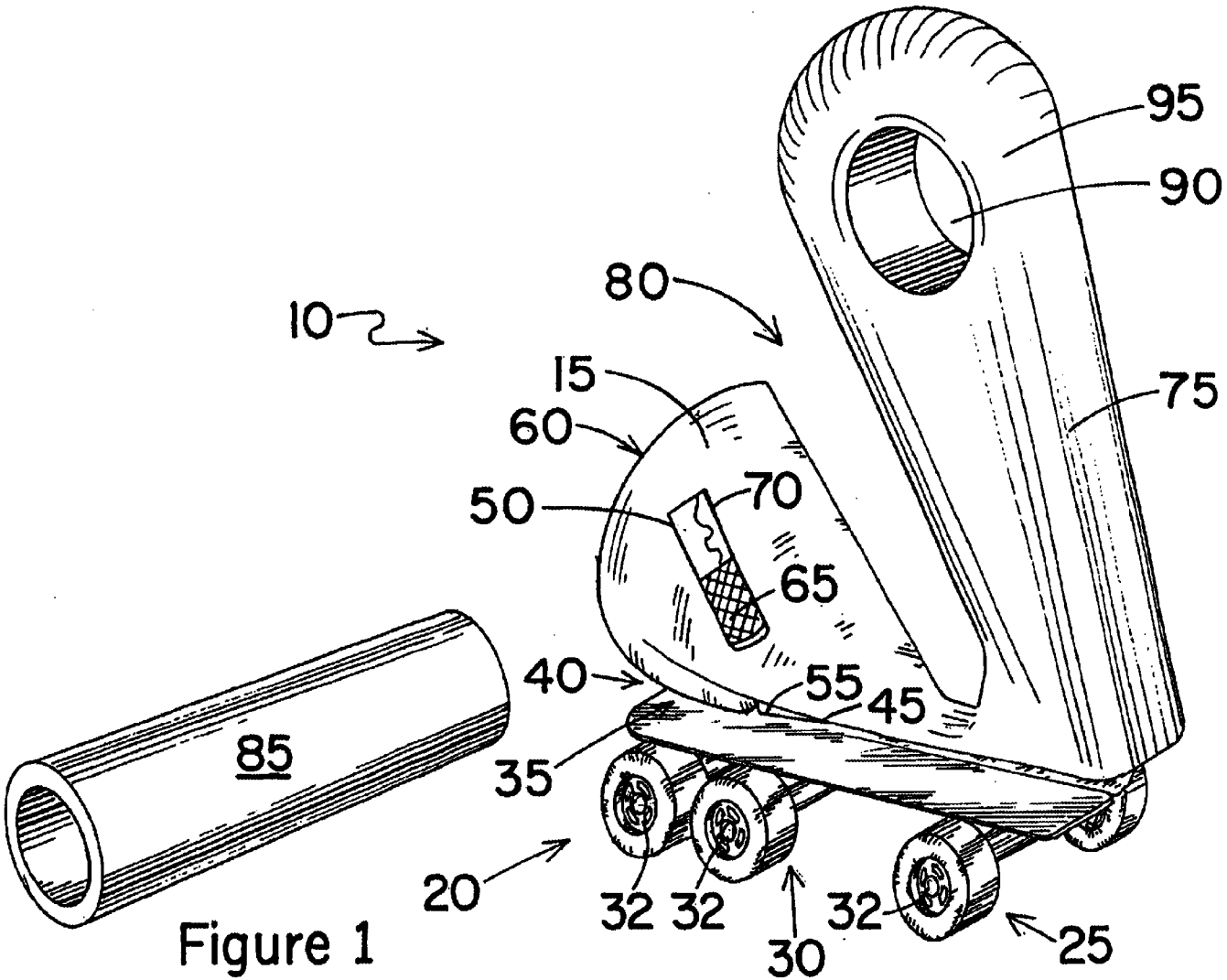
FIG. 1 shows a perspective view of the mobile cutting device and separate linear crossbar member of one embodiment of the present invention.

While the invention is amenable to various modifications and alternative forms, specifics thereof have been shown by way of example in the drawings and will be described in detail. It should be understood, however, that the intention is not necessarily to limit the invention to the particular embodiments described. On the contrary, the intention is to cover all modifications, equivalents, and alternatives falling within the spirit and scope of the invention, as defined by the appended claims.

DESCRIPTION OF THE EMBODIMENTS

The present invention is directed to a mobile device for cutting sheet material, including a planar body member supported vertically on rolling support means for translational movement of the device on a support surface. In one embodiment, the rolling support means includes wheeled axles positioned in a plane and oriented perpendicularly to the vertical planar body member. Other rolling support means, such as track-type supports, rollers, or contained spheres, can be secured to the planar body member with equivalent results. The planar body member includes a cutting notch with open and closed ends, with the notch open end positioned adjacent and above the rolling support means. The planar body member also includes a contained cutting blade member with a cutting edge exposed within the cutting notch closed end. A handle member is secured to, and coplanar with, the planar body member, with the handle member extending upwardly, opposite the rolling support means. The handle member and planar body member form a grasping notch there between. A user grasps the handle member and rolls the planar body member forward on the rolling support means to cut a sheet of material passing into the cutting notch.

Referring to FIGS. 1–5, several embodiments of the wheeled device for cutting sheet material of the present invention is shown. The wheeled cutting device 10 includes a planar body member 15 supported vertically on a rolling support means, such as a front wheeled axle 20 and a rear wheeled axle 25. The wheeled axles 20, 25 are oriented perpendicularly to the vertical planar body member 15 and are positioned in a plane so that the wheels 32 contact a flat surface to provide stable support for the vertical planar body member 15. In a further embodiment of the invention, a third wheeled axle 30 is secured perpendicularly to the vertical planar body member 15, adjacent the front wheeled axle 20 and coplanar therewith, to provide additional stability in supporting the vertical planar body member 15. The Figures show all three wheeled axles 20, 25, 30 present and in a common plane.

The planar body member 15 includes a cutting notch 35 with an open end 40 and a closed end 45, with the notch 35 positioned adjacent the front wheeled axle 20 and the notch open end 40 forward of the front wheeled axle 20. Preferably, the cutting notch 35 is essentially parallel to the plane of the wheeled axles 20, 25.

The planar body member 15 also includes a contained cutting blade member 50 with a cutting edge 55 exposed within the cutting notch closed end 45. The cutting blade member 50 is preferably positioned on a centerline of the planar body member 15. The planar body member 15 contains a blade slot 60 that accepts and secures the cutting blade member 50 within the body member 15. The blade slot 60 intersects the cutting notch 35 so as to position the blade cutting edge 55 at the cutting notch closed end 45. Preferably, the blade cutting edge 55 is angled in the cutting notch 35 from the open end 40 toward the closed end 45. As the sheet material rides on the edges of the cutting notch 35, the sheet is supported as the angled cutting edge 55 moves through the material. The blade member 50 is preferably secured to a sliding blade positioner 65 that moves in a linear slot 70 in the body member 15 to assist in inserting and removing the blade member 50 from the blade slot 60. The blade member 50 is preferably a single or double-edged razor blade that is readily available at retail outlets. The blade member 50 is completely contained within the body member 15, so that only a small portion of the cutting edge 55 is exposed at the cutting notch closed end 45, thereby preventing dangerous exposure of the blade cutting edge 55 during use.

Figure 2:
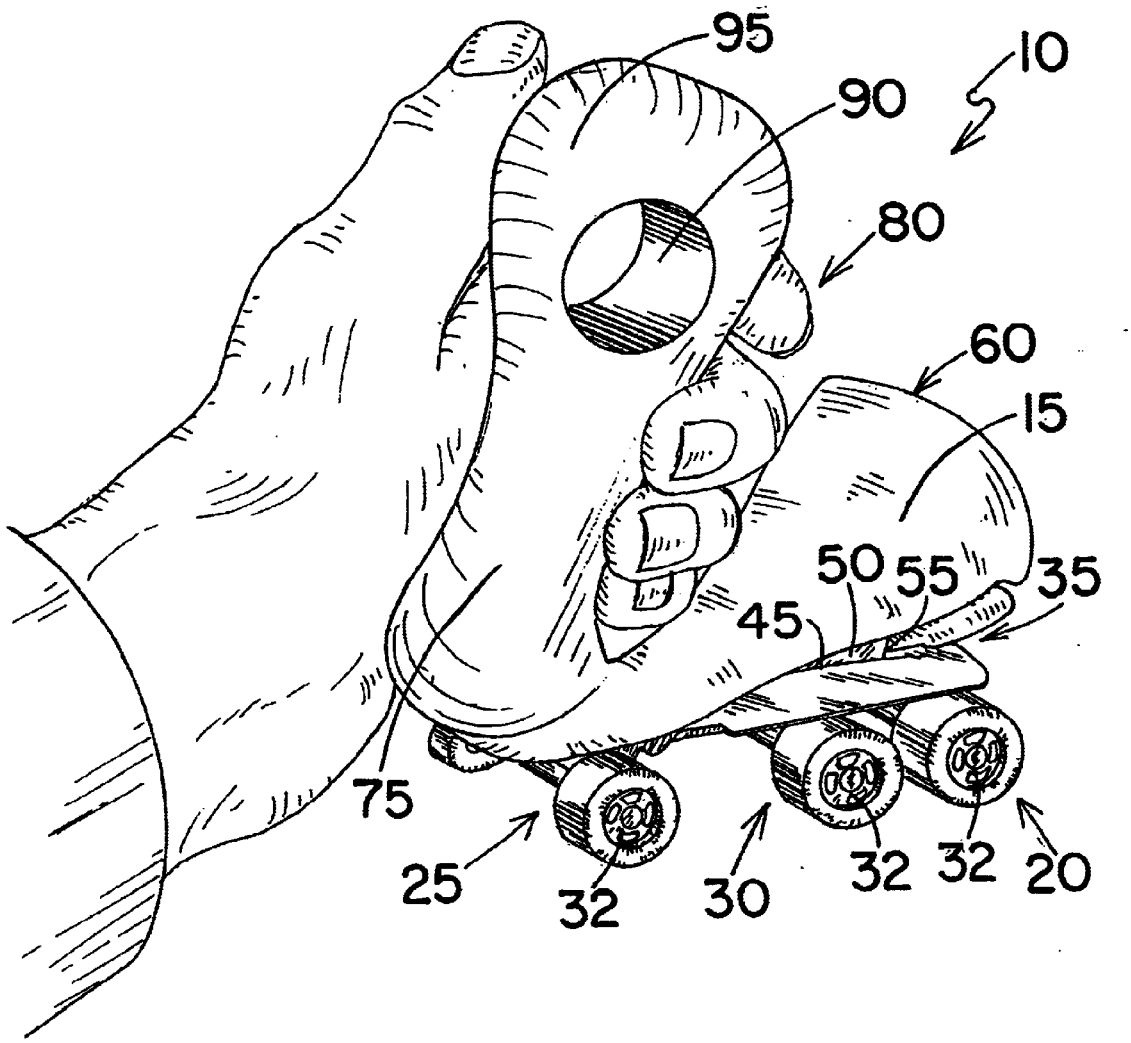
FIG. 2 shows a perspective view of a user grasping the handle of the mobile cutting device for one embodiment of the present invention.
Figure 3:
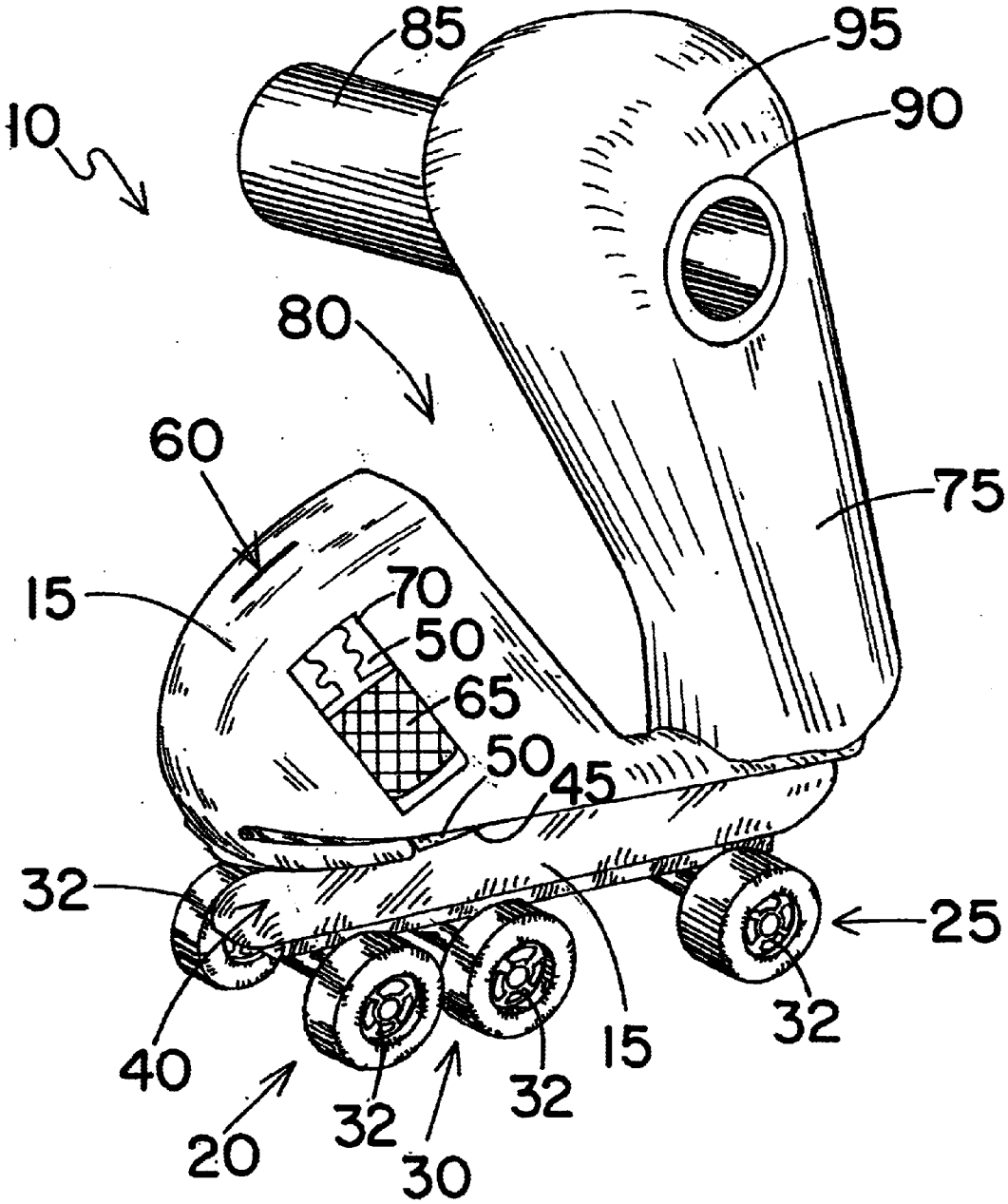
FIG. 3 shows a perspective view of the mobile cutting device with a linear crossbar member installed for another embodiment of the present invention.
Figure 4:
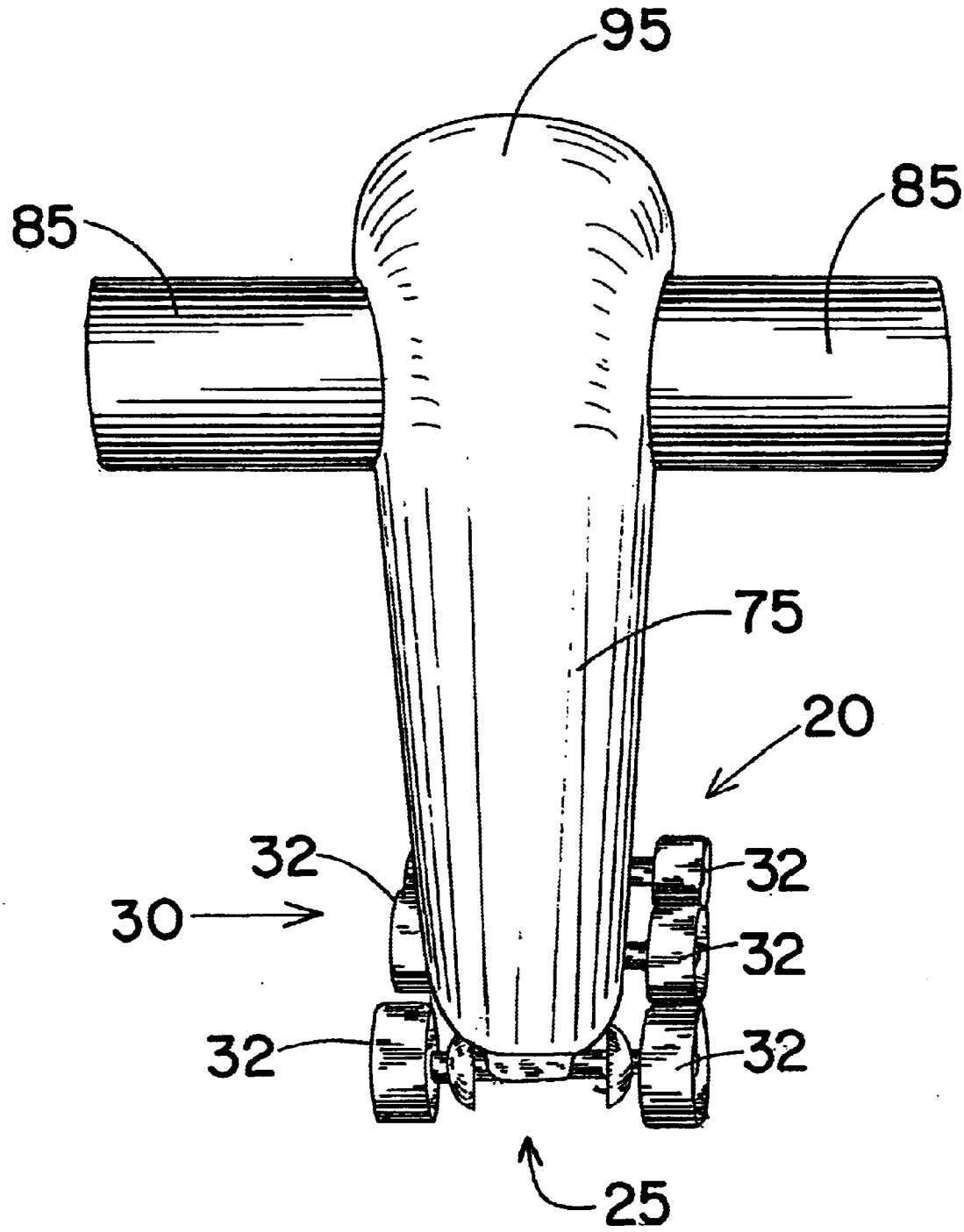
FIG. 4 shows a rear view of the mobile cutting device with a linear crossbar member installed for another embodiment of the present invention.
Figure 5:
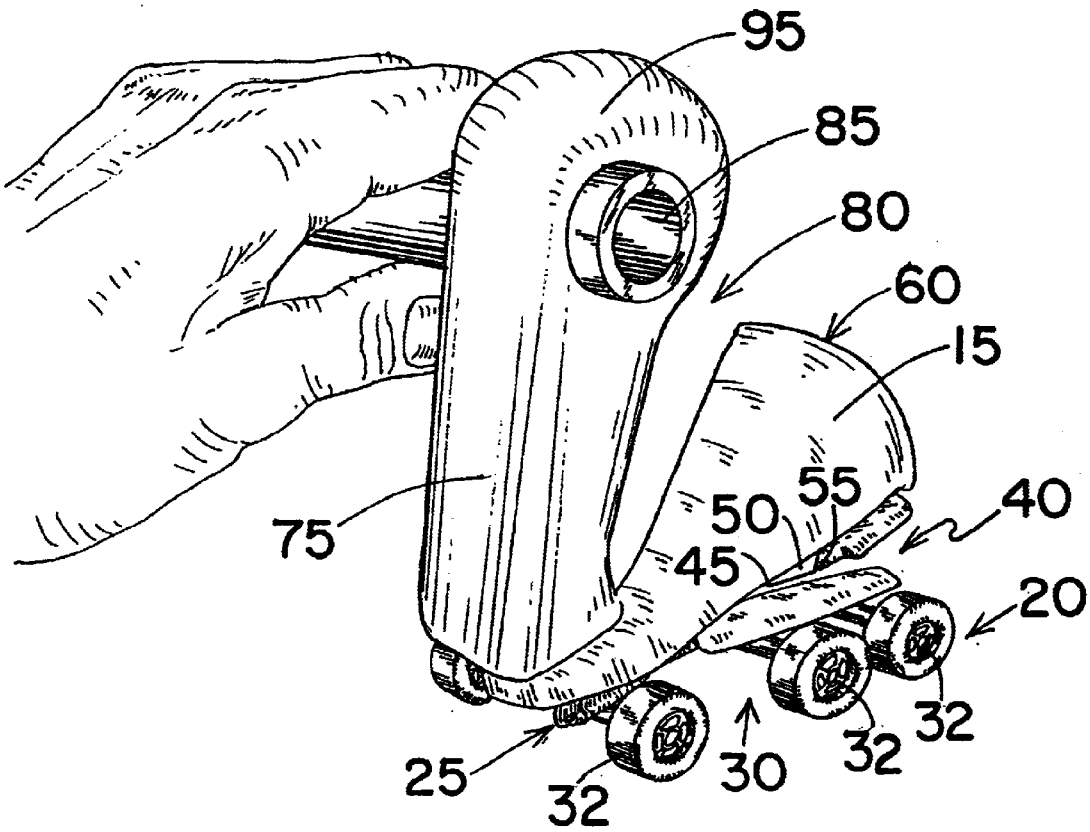
FIG. 5 shows a perspective view of a user grasping the linear crossbar member secured to the mobile cutting device for another embodiment of the present invention.

A bulbous handle member 75 is secured to, and coplanar with, the planar body member 15, with the handle member 75 extending upwardly opposite the rear wheeled axle 25. The handle member 75 and the planar body member 15 form a grasping notch 80 there between. As illustrated in FIG. 2, a user grasps the bulbous handle member 75, with the user's fingers in the grasping notch 80, and rolls the planar body member 15 forward on the wheeled axles 20, 25, 30, to cut a sheet of material passing into the cutting notch 35 by the cutting edge 55 exposed therein. Preferably, the handle member 75 is inclined away from vertical and toward the front wheeled axle 20, forming an angle of about 70 degrees with the plane of the wheeled axles 20, 25, 30.

In a further embodiment of the invention, a linear crossbar member 85 is positioned perpendicularly to the planar body member 15 in an aperture 90 in the bulbous handle member aperture 90 to provide an easily grasped appendage for the handle member 75. Most preferably, the aperture 90 and linear crossbar member 85 are positioned near an end 95 of the bulbous handle member 75 opposite the rear wheeled axle 25. The linear crossbar member 85 is preferably cylindrical and the aperture 90 is round, for ease of insertion and removal, although other geometrical shapes are contemplated for both the crossbar member 85 and the aperture 90. The linear crossbar member 85 slides within the aperture 90 so that the crossbar member 85 can be extended to either side of the handle member 75, at the discretion of the user. Similarly, the crossbar member 85 can be completely removed from the aperture 90, if the user desires.

The bulbous handle member 75 thus provides an easily grasped portion of the wheeled cutting device 10. The linear crossbar member 85 secured to the handle member 75 provides an additional easily grasped portion, allowing the user many choices for holding and operating the cutting device 10.

While the present invention has been described with reference to several particular example embodiments, those skilled in the art will recognize that many changes may be made thereto without departing from the spirit and scope of the present invention, which is set forth in the following claims.

I claim:

1. A mobile device for cutting sheet material comprising;

(a) a planar body member mounted vertically on rolling support means for translational movement of said vertical planar body member on a surface;

(b) said planar body member including a cutting notch with open and closed ends, said notch positioned with said open end adjacent and above said rolling support means;

(c) said planar body member including a contained cutting blade member with cutting edge exposed within said cutting notch closed end; and (d) a handle means secured to, and coplanar with, said planar body member, said handle means extending upwardly opposite said rolling support means, said handle means and planar body member forming a grasping notch there between, whereby a user grasps the handle means and rolls the planar body member forward on the rolling support means to cut a sheet of material passing into said cutting notch.

2. The mobile device for cutting sheet material according to claim 1 wherein said rolling support means comprises a front wheeled axle and a rear wheeled axle, said axles positioned in a plane and oriented perpendicularly to said vertical planar body member.

3. The mobile device for cutting sheet material according to claim 2 further comprising a third wheeled axle secured perpendicularly to said planar base member adjacent said front wheeled axle and coplanar therewith.

4. The mobile device for cutting sheet material according to claim 1 wherein said handle means defines an aperture for receiving a crosspiece member.

5. The mobile device for cutting sheet material according to claim 1 further comprising a linear crossbar member positioned perpendicularly to said planar body member in an aperture in said handle means.

6. The mobile device for cutting sheet material according to claim 5 wherein, said handle means aperture and linear crossbar member are positioned near an end of said handle means opposite said rolling support means.

7. The mobile device for cutting sheet material according to claim 5 wherein, said linear crossbar member is removeably positioned in said aperture in said handle means.

8. The mobile device for cutting sheet material according to claim 1 wherein, said contained cutting blade member is removable from said planar body member.

9. The mobile device for cutting sheet material according to claim 2 wherein, said cutting notch is essentially parallel to said plane of said wheeled axles.

10. The mobile device for cutting sheet material according to claim 1 wherein, said contained cutting blade member is positioned on a centerline of said planar body member.

11. A wheeled device for cutting sheet material comprising;

(a) a planar body member supported vertically on a front wheeled axle and a rear wheeled axle, said axles positioned in a plane and oriented perpendicular to said vertical planar body member;

(b) said planar body member including a cutting notch with open and closed ends, said notch positioned adjacent and above said front wheeled axle with open end forward thereof;

(c) said planar body member including a contained cutting blade member with cutting edge exposed within said cutting notch closed end; and (d) a bulbous handle member secured to, and coplanar with, said planar body member, said handle member extending upwardly opposite said rear wheeled axle, said handle member and planar body member forming a grasping notch there between, whereby a user grasps the bulbous handle member and rolls the planar body member forward on the wheeled axles to cut a sheet of material passing into said cutting notch.

12. The wheeled device for cutting sheet material according to claim 11 further comprising a third wheeled axle secured perpendicularly to said planar base member adjacent said front wheeled axle and coplanar therewith.

13. The wheeled device for cutting sheet material according to claim 11 further comprising a linear crossbar member positioned perpendicularly to said planar body member in an aperture in said bulbous handle member.

14. The wheeled device for cutting sheet material according to claim 13 wherein, said handle member aperture and linear crossbar member are positioned near an end of said bulbous handle member opposite said rear wheeled axle.

15. The wheeled device for cutting sheet material according to claim 13 wherein, said linear crossbar member is removeably positioned in said aperture in said bulbous handle member.

16. The wheeled device for cutting sheet material according to claim 11 wherein, said cutting notch is essentially parallel to said plane of said wheeled axles.

17. The wheeled device for cutting sheet material according to claim 11 wherein, said contained cutting blade member is removable from said planar body member.

18. The wheeled device for cutting sheet material according to claim 11 wherein, said contained cutting blade member is positioned on a centerline of said planar body member.

19. The wheeled device for cutting sheet material according to claim 11 wherein, said bulbous handle member is inclined at about 70 degrees to said plane of said wheeled axles.

20. A wheeled device for cutting sheet material comprising;

(a) a planar body member supported vertically on a front wheeled axle and a rear wheeled axle, said axles positioned in a plane and oriented perpendicularly to said vertical planar body member;

(b) said planar body member including a cutting notch with open and closed ends, said cutting notch oriented essentially parallel to said plane of said wheeled axles and positioned adjacent said front wheeled axle with open end forward thereof;

(c) said planar body member including a contained cutting blade member positioned on a center line thereof, with cutting edge exposed within said notch closed end; and (d) a bulbous handle member secured to, and coplanar with, said planar body member, said handle member extending upwardly opposite said rear wheeled axle, said handle member and planar body member forming a grasping notch there between; whereby a user grasps the bulbous handle member and rolls the planar body member forward on the wheeled axles to cut a sheet of material passing into said cutting notch.

21. The wheeled device for cutting sheet material according to claim 20 further comprising a third wheeled axle secured perpendicularly to said planar base member adjacent said front wheeled axle and coplanar therewith.

22. The wheeled device for cutting sheet material according to claim 20 further comprising a linear crossbar member positioned perpendicularly to said planar body member in an aperture in said bulbous handle member.

23. The wheeled device for cutting sheet material according to claim 22 wherein, said handle member aperture and linear crossbar member are positioned near an end of said bulbous handle member opposite said rear wheeled axle.

24. The wheeled device for cutting sheet material according to claim 22 wherein, said linear crossbar member is removeably positioned in said aperture in said bulbous handle member.

25. The wheeled device for cutting sheet material according to claim 20 wherein, said contained cutting blade member is removable from said planar body member.

26. The wheeled device for cutting sheet material according to claim 20 wherein, said bulbous handle member is inclined at about 70 degrees to said plane of said wheeled axles.

27. A wheeled device for cutting sheet material comprising;

(a) a planar body member supported vertically on a front wheeled axle and a rear wheeled axle, said axles positioned in a plane and oriented perpendicularly to said vertical planar body member;

(b) said planar body member including a cutting notch with open and closed ends, said cutting notch oriented essentially parallel to said plane of said wheeled axles and positioned adjacent said front wheeled axle with open end forward thereof, (c) said planar body member including a contained cutting blade member positioned on a center line thereof, with cutting edge exposed within said notch closed end;

(d) a bulbous handle member secured to, and coplanar with, said planar body member, said handle member extending upwardly opposite said rear wheeled axle, said handle member and planar body member forming a grasping notch there between; and (e) a linear crossbar member positioned perpendicularly to said planar body member in an aperture in said bulbous handle member near an end thereof opposite said rear wheeled axle, whereby a user grasps the bulbous handle member and rolls the planar body member forward on the wheeled axles to cut a sheet of material passing into said cutting notch.

28. The wheeled device for cutting sheet material according to claim 27 further comprising a third wheeled axle secured perpendicularly to said planar base member adjacent said front wheeled axle and coplanar therewith.

29. The wheeled device for cutting sheet material according to claim 27 wherein, said linear crossbar member is removeably positioned in said aperture in said bulbous handle member.

30. The wheeled device for cutting sheet material according to claim 27 wherein, said contained cutting blade member is removable from said planar body member.

31. The wheeled device for cutting sheet material according to claim 27 wherein, said bulbous handle member is inclined at about 70 degrees to said plane of said wheeled axles.

* * * * *